US005586341A

United States Patent [19]

Hill, Jr.

[11] Patent Number: 5,586,341

[45] Date of Patent: Dec. 24, 1996

[54] STOCKINGS AND METHODS THEREFORE

[76] Inventor: Bruce U. Hill, Jr., 735 Field Club Rd., Pittsburgh, Pa. 15238

[21] Appl. No.: 537,088

[22] Filed: Sep. 29, 1995

[51] Int. Cl.[6] ..... A41B 11/00

[52] U.S. Cl. ..... 2/239; 2/244; D2/985; D2/994

[58] Field of Search ..... 2/239, 244, 246, 2/240, 22; D2/980, 981, 982, 983, 985, 993, 994

[56] References Cited

U.S. PATENT DOCUMENTS

| | | | |
|---|---|---|---|
| D. 74,991 | 4/1928 | Taubel | D2/985 |
| D. 85,544 | 11/1931 | Peters | D2/981 |
| D. 161,481 | 1/1951 | Magnier | D2/988 |
| D. 167,350 | 7/1952 | Ischinger | D2/988 |
| D. 169,756 | 6/1953 | Ischinger | D2/985 |
| D. 182,249 | 3/1958 | Rock | D2/981 |
| D. 365,674 | 1/1996 | Coles | D2/980 |
| 2,193,056 | 3/1940 | Burn | 2/239 |
| 2,268,818 | 1/1942 | Goodman | 2/239 |
| 2,361,501 | 10/1944 | Salzberg | 2/239 |
| 2,569,434 | 9/1951 | Ischinger | 2/239 |
| 2,601,115 | 6/1952 | Gordon | 2/239 |
| 2,729,824 | 1/1956 | Doll, Jr. | 2/239 |
| 3,001,203 | 9/1961 | Hassler | 2/239 |
| 4,058,853 | 11/1977 | Boxer et al. | 2/239 |
| 4,104,892 | 8/1978 | Thorneburg | 2/239 |
| 5,038,413 | 8/1991 | Ursino | 2/239 |
| 5,329,640 | 7/1994 | Hourigan | 2/239 |

*Primary Examiner*—Amy B. Vanatta

[57] ABSTRACT

A mid-calf or greater length stocking which has an orientation marker located at or near the top front centerline of the sleeve of the stocking, in a visible color or composition different than the stocking color so that the wearer can align the stocking on the wearer's foot when drawing the stocking onto the wearer's foot and leg. The orientation marker may be a geometric symbol,letter, monogram, trademark or creative design of any type.

7 Claims, 2 Drawing Sheets

STOCKINGS AND METHODS THEREFORE

FIELD OF THE INVENTION

This invention relates to stockings and more particularly to men's stockings of mid-calf or higher length.

BACKGROUND OF THE INVENTION

Mid-calf and calf-length stockings by their very nature, tend to be difficult to align on one's foot and calf. This is true because the tube or sleeve can be pulled onto the foot in any orientation with the foot section often mis-aligned from the wearer's foot. Because stockings are generally stretchable, the tube or sleeve portion gets stretched out of alignment with the foot section if the foot section is mis-aligned at entry of the wearer's foot.

At one time stockings, particularly women's hosiery, had seams which the wearer would align with the back of his or her leg to assure a proper orientation. Today hosiery of all kinds are manufactured seamless so that the orientation problem is ever present, particularly where the hosiery is of mid calf or higher in length.

It is the object of this invention to provide a stocking which overcomes the drawbacks of previous hosiery and permits ease of proper alignment on one's foot and leg. In addition the invention provides a new design feature which adds to the aesthetics of the wearing apparel.

SUMMARY OF THE INVENTION

My invention is an orientation marker positioned at or near the top of a stocking, generally of mid-calf or higher in length. The market is positioned along the stocking front and along a plane that bisects the stocking into substantially symmetrical halves. The wearer aligns the marker of the stocking along the center of wearer's foot and pulls the stocking onto wearer's foot and leg while maintaining the orientation marker along the imaginary vertically extending plane which bisects its foot and leg.

The orientation market can be integrally formed with the stocking and merely of a different color. The marker can also be of a different composition than the stocking and can be sewn in place. Likewise the marker can be of a geometric shape, a monogram, other indicia associated with the wearer, or can be simply a creative design.

DESCRIPTION OF THE PREFERRED EMBODIMENT

Figure 1:
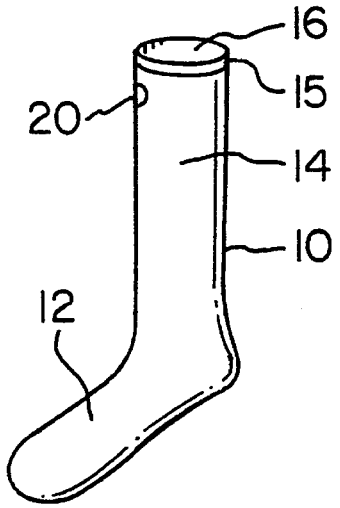
FIG. 1 is a side view of the stocking showing the location of the orientation marker.
Figure 2:
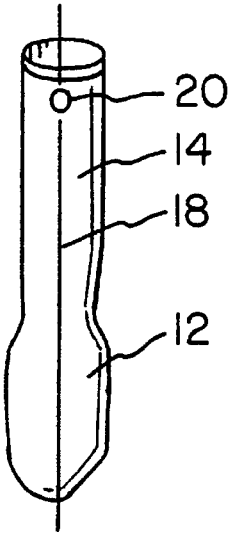
FIG. 2 is a front view of the stocking in FIG. 1 showing the location of the orientation marker.

The stocking, generally designated 10, is normally of mid-calf length or higher, FIGS. 1 and 2. The stocking includes a conventional foot section 12 and an integrally formed tube or sleeve section 14 which fits onto the wearer's leg. The sleeve 14 has an entry 16 along the upper surface 15 of sleeve 14 to provide access for the wearer's foot.

An orientation market 20 is located at the upper surface 15 or near the upper surface 15 of stocking 10. The marker is located along the vertical centerline 18 of the stocking 10, which centerline is vertically extending and symmetrically bisects the stocking 10 into substantially equal halves.

The orientation marker 20 can be designed and configured to enhance the appearance of the stocking. The orientation marker 20 in its simplest form can merely be formed by using a different color thread in that portion of the stocking 10, or sewing a thread or other type of emblem on to the stocking 10 in the proper location.

Figure 3:
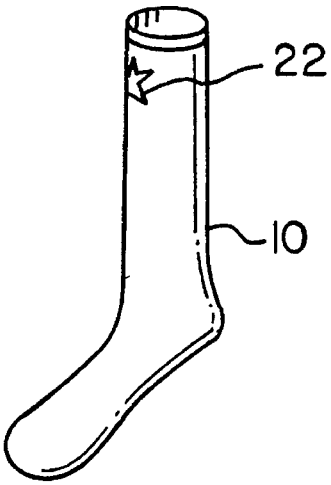
FIG. 3 is a side view of the stocking showing the location of a geometric symbol orientation marker.
Figure 4:
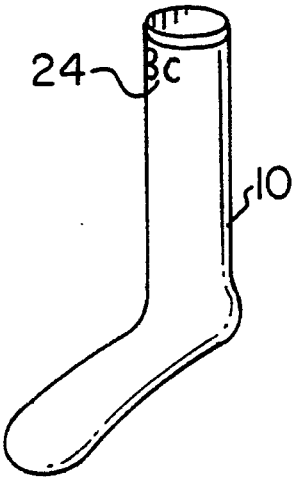
FIG. 4 is a side view of the stocking showing the location of a monogram orientation marker.
Figure 4A:
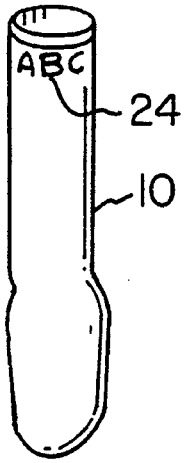
FIG. 4A is a front view of FIG. 4 showing the location of the monogram orientation marker.

A geometric shape, namely Star 22, can be used to form such a marker, see FIG. 3. Likewise a person's initials 24 can be used as the marker, see FIGS. 4 and 4A.

Figure 5:
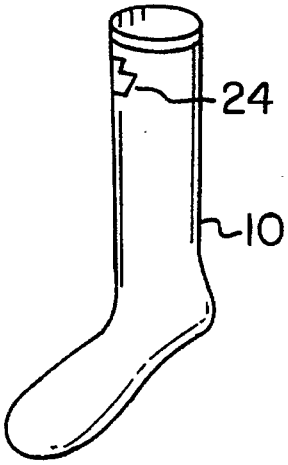
FIG. 5 is a side view of the stocking showing the location of a trademark orientation marker.
Figure 5A:
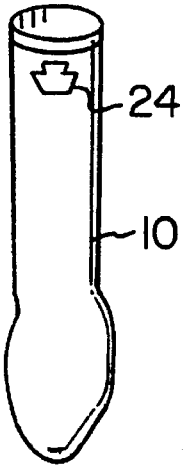
FIG. 5A is a front view of FIG. 5 showing the location of the trademark orientation marker.
Figure 6:
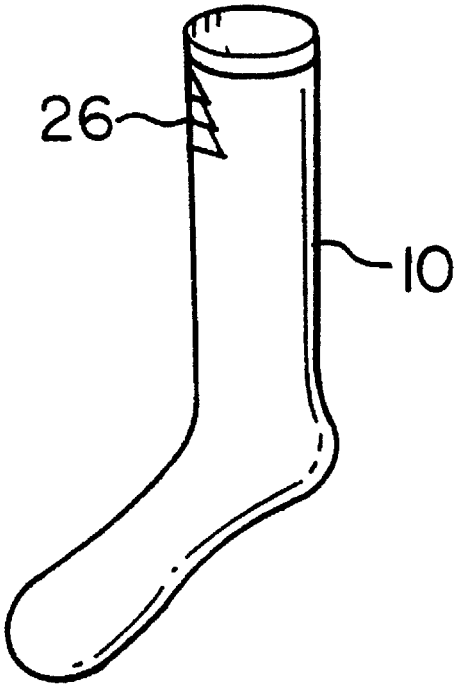
FIG. 6 is a sideview of the stocking showing the location of a creative design orientation marker.
Figure 6A:
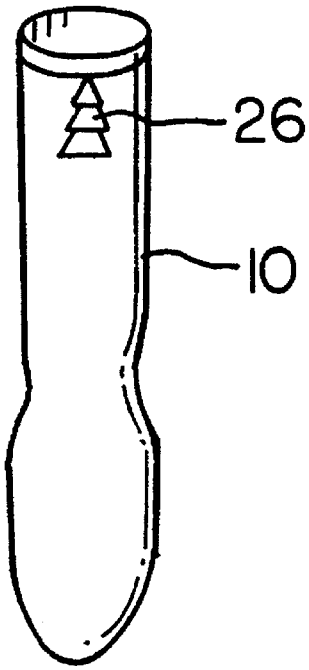
FIG. 6A is a front view of FIG. 6 showing the location of the creative design orientation marker.

Designs of any kind or trademarks associated with an individual wearer can be also forms of the orientation marker 20. Orientation marker 20 is in the form of a keystone, symbol 24, FIGS. 5 and 5A, and is in the form of an evergreen tree, symbol 26, FIGS. 6 and 6A.

To place the stocking on one's foot, the wearer, (not shown), merely grips the stocking 10 so that the orientation marker 20 is directed along the top of the foot and along the longitudinal centerline thereof. The stocking is pulled along the foot maintaining that same orientation with respect to the marker and foot. The stocking is then pulled over the foot and up the leg while maintaining the marker in alignment within an imaginary plane which extends along the vertical centerline of the wearer's foot and leg.

Although particular embodiments of the invention have been described and illustrated herein, it is recognized that modifications and variations can occur within the scope of the appended claims.

I claim:

1. A stocking comprising:

a foot section;

a sleeve section extending upwardly from said foot section to at least midcalf in length, said sleeve section having a lower surface attached to said foot section and an upper section adjacent an opening adaption to receive the user's foot and leg; and an orientation marker positioned only on said upper section of said sleeve section on a front side of said sleeve section, said orientation marker lying in a vertically extended plane which substantially symmetrically bisects said stocking, wherein said foot section and said lower surface of said sleeve section are free of said orientation marker.

2. The stocking of claim 1 wherein said orientation marker is of a color different from the color of said sleeve.

3. The stocking of claim 1 wherein said orientation marker is of a composition different from the composition of said sleeve.

4. The stocking of claim 1 wherein said orientation marker is a geometric shape.

5. The stocking of claim 1 wherein said orientation marker is a monogram.

6. The stocking of claim 1 wherein said orientation marker is an indicia suggestive of a wearer of said stocking.

7. The stocking of claim 1 wherein said orientation marker is a creative design.

* * * * *